US009539713B2

(12) United States Patent
Schafer

(10) Patent No.: US 9,539,713 B2
(45) Date of Patent: Jan. 10, 2017

(54) AUTOMOTIVE TOOL FOR ENGAGEMENT AND REMOVAL OF AN INSIDE DOOR HANDLE CABLE SHEATH BUSHING

(71) Applicant: Lisle Corporation, Clarinda, IA (US)

(72) Inventor: Derek Schafer, Columbus, NE (US)

(73) Assignee: Lisle Corporation, Clarinda, IA (US)

( * ) Notice: Subject to any disclaimer, the term of this patent is extended or adjusted under 35 U.S.C. 154(b) by 167 days.

(21) Appl. No.: 14/491,331

(22) Filed: Sep. 19, 2014

(65) Prior Publication Data

US 2015/0224636 A1 Aug. 13, 2015

Related U.S. Application Data

(60) Provisional application No. 61/886,436, filed on Oct. 3, 2013.

(51) Int. Cl.
*B25B 27/28* (2006.01)

(52) U.S. Cl.
CPC ..... *B25B 27/28* (2013.01); *Y10T 29/49815* (2015.01); *Y10T 29/53657* (2015.01)

(58) Field of Classification Search
CPC ..... B25B 27/28; Y10T 29/49815; Y10T 29/53657
See application file for complete search history.

(56) References Cited

U.S. PATENT DOCUMENTS 922,914 A * 5/1909 Kingsbury ..... B62B 3/001 280/1.23

OTHER PUBLICATIONS

Jan. 29, 2013—Idea Disclosure Agreement—inside door handlecable release tool—submitted by Derek Schafer.

* cited by examiner

*Primary Examiner* — John C Hong
(74) *Attorney, Agent, or Firm* — Banner & Witcoff, Ltd.

(57) ABSTRACT

An automotive tool for engaging and removing a cable guide bushing from a bushing passage in an inner door panel of a vehicle door is comprised of elongate, generally rectangular, parallelepiped bar with a manual grip at one end and a generally circular, through-passage at the opposite end with a radial slot through the bar connected to the through passage. The through-passage includes first and second uniformly, equally arcuate, constant radius surfaces at the juncture of the top side and bottom side of the bar with the through-passage to facilitate smooth engagement, and placement of the through passage over the compressible legs of the cable guide bushing in a manner which compresses the legs to enable removal of the bushing from a retaining passage in the inside panel from the inside of the door.

3 Claims, 5 Drawing Sheets

AUTOMOTIVE TOOL FOR ENGAGEMENT AND REMOVAL OF AN INSIDE DOOR HANDLE CABLE SHEATH BUSHING

CROSS REFERENCE TO RELATED APPLICATION

This is a utility application incorporating by reference and claiming priority to provisional application Ser. No. 61/886,436 filed Oct. 3, 2013 entitled "Automotive Tool for Engagement and Removal of an Inside Door Handle Cable Sheath Bushing".

BACKGROUND OF THE INVENTION

In a principal aspect the present invention relates to a specialty automotive tool which may be used for disengagement of an annular, compressible bushing that functions to retain a cable sheath attached to an inside door panel of a vehicle door. The bushing is thus attached or positioned at one end of the hollow, cable sheath. The sheath and bushing receive a cable that extends through the sheath and bushing for connection to the inside vehicle door handle mounted to the inside vehicle door panel. The bushing is mounted in a slot or opening of a bracket on the inside face of the inside door panel.

That is, the door construction of various vehicles typically may include an outside panel with a door latch and an inside panel fitted on the outside panel. An inside door handle mounted within the vehicle on the inside door panel is operable to actuate the door latch by means of a connecting cable fitted in the space between the outside door panel and the inside door panel. The cable provides a linkage between the inside door handle mounted on the inside door panel and the door latch mounted on the outside door panel. Typically, the cable is housed in a protective sheath. One end of the sheath is affixed to the inside door panel of the vehicle door. The opposite end of the sheath is attached to the housing for the door latch mounted on the outside door panel. The sheath protects the cable within the sheath which moves freely and independently of the sheath in response to actuation of the inside door handle. The sheath thus protects the cable from wear and interference with other components in the space between the inside door panel and the outside door panel of the vehicle door construction.

Often the sheath is affixed or attached to an inside panel bracket by means of an annular bushing positioned at the inside end of the sheath. The annular bushing may include compressible dogs or ears which enable the bushing to be snap fitted into a compatible opening of the bracket affixed to the inside door panel.

To repair the door or a latch mechanism or a handle, a mechanic will typically disengage and detach the inside door panel from the outside door panel. Then the mechanic will detach the bushing the protective sheath and the cable from the inside door panel and the door handle. Detachment of the cable, bushing and sheath from the inside door panel is often a difficult task.

That is, the door construction, including the arrangement of the inside door handle, of the latch in the door, and the repair operation associated with the door construction are illustrated in the following internet site: www.utube.com/watch?v+vgfos6xo-im. The internet site depicts the procedure to disassemble a vehicle door by separating and removing an inner door panel from the outside door panel including detachment of the inside door handle from the cable which is connected thereto and which has its opposite end connected via the cable to the door latch mounted on the outside door panel. The series of steps to accomplish this disassembly is facilitated by the use of a pick in the form of a dental pick which the mechanic uses to disengage the various component parts connecting the inside door panel and the various controls in the door including the cable and bushing for the cable sheath. A component which requires detachment or removal from the inside door panel in order to repair the vehicle door latch or the door panel typically includes the cable guide bushing. Removal of the cable guide bushing from the inner door panel allows detachment of the cable from that inside door panel.

Mechanics have found that an especially difficult step in the removal process is disengagement of the cable guide bushing from the inside door panel. Removal typically requires compression of ears or dogs which are positioned on the perimeter or rim of the annular bushing. That is, the dogs or ears typically must be compressed in order to remove the bushing from the inner door panel. In the past this was accomplished by use of a pick or alternatively by a pliers, such as a needle nose pliers. Such tools, though potentially effective, often require extra time, diligence and experience in order to successfully accomplish the objective of removal of the cable guide bushing to thereby achieve release of the cable and sheath from attachment to the inside door panel.

Thus, there has developed a need for an improved tool which will enable a mechanic or auto technician to quickly, easily and successfully disengage a cable guide bushing from the inside door panel of a vehicle door assembly or construction, thereby enabling removal of the cable sheath, bushing and cable from connection with the inside door panel and ultimately removal of the guide sheath and/or the cable from the door assembly for replacement or repair.

SUMMARY OF THE INVENTION

Briefly the present invention comprises an automotive tool designed and capable of engaging and removing a cable guide bushing by placement of the tool in contact with or against the bushing, compression of the bushing in a required and desired manner to thereby enable removal of the bushing from a bushing bracket passage or opening in the inner door panel to which the bushing is engaged. The tool is an elongate, generally rectangular, parallelepiped bar having a first handle or grip end and an opposite, second, cable bushing guide and engagement end. The bar has a longitudinal dimension and a substantially straight, longitudinal, medial axis between the opposite ends. Further the bar has a generally uniform thickness dimension transverse to the longitudinal axis between a flat top surface and a flat bottom surface.

The first end comprises a grip for holding the tool. The second end includes a generally circular through-passage transverse to the axis and to the thickness dimension. The through-passage is characterized by a generally continuous smooth sided circular opening having a constant radius with a center located generally on the medial longitudinal axis. The top surface and bottom surface of the generally rectangular, parallelepiped bar are generally flat at the second end. The top and bottom surfaces are parallel to the longitudinal axis and are connected by a circular curved distal end surface having a uniform radius with respect to the center of the through-passage and parallel opposite lateral side surface joined to the curved distal end surface. A radial slot extends in a paternal side surface between the top surface and bottom surface is connected to the circular through-passage. The width of the radial slot comprises about 6 to 14% of the circumferential dimension of the through-passage. The longitudinal dimension of the rectangular bar is at least about two times the circumference of the through-passage. The thickness dimension of the second end between the lateral side walls of the parallelepiped, generally rectangular bar is in the range of about ¼ to ⅛ the circumference of the through-passage. The through-passage includes first and second uniformly, equally arcuate, constant radius surfaces at the juncture of the top and bottom sides of the bar joined to the annular constant diameter surface of the through-passage. The circular, curved distal end surface has a radius in the range of about 1.2 to 1.5 the radius of the through-passage.

Thus it is an object of the invention to provide an improved tool for removal of a cable guide or sheath bushing from engagement with the inside door panel of a vehicle.

A further object of the invention is to provide an automotive tool for removal of a cable guide or sheath bushing which is easy to use, rugged, having a simple yet effective construction, inexpensive and which requires minimal manipulation in order to effect a desired cable guide sheath or guide bushing removal.

These and other objects, advantages and features of the invention will be set forth in the detailed description which follows.

BRIEF DESCRIPTION OF THE DRAWING AND DIAGRAMS

In the description which follows reference will be made to the drawing, various photographs and other illustrative materials as follows.

DETAILED DESCRIPTION OF AN EMBODIMENT OF THE INVENTION

Figure 1:
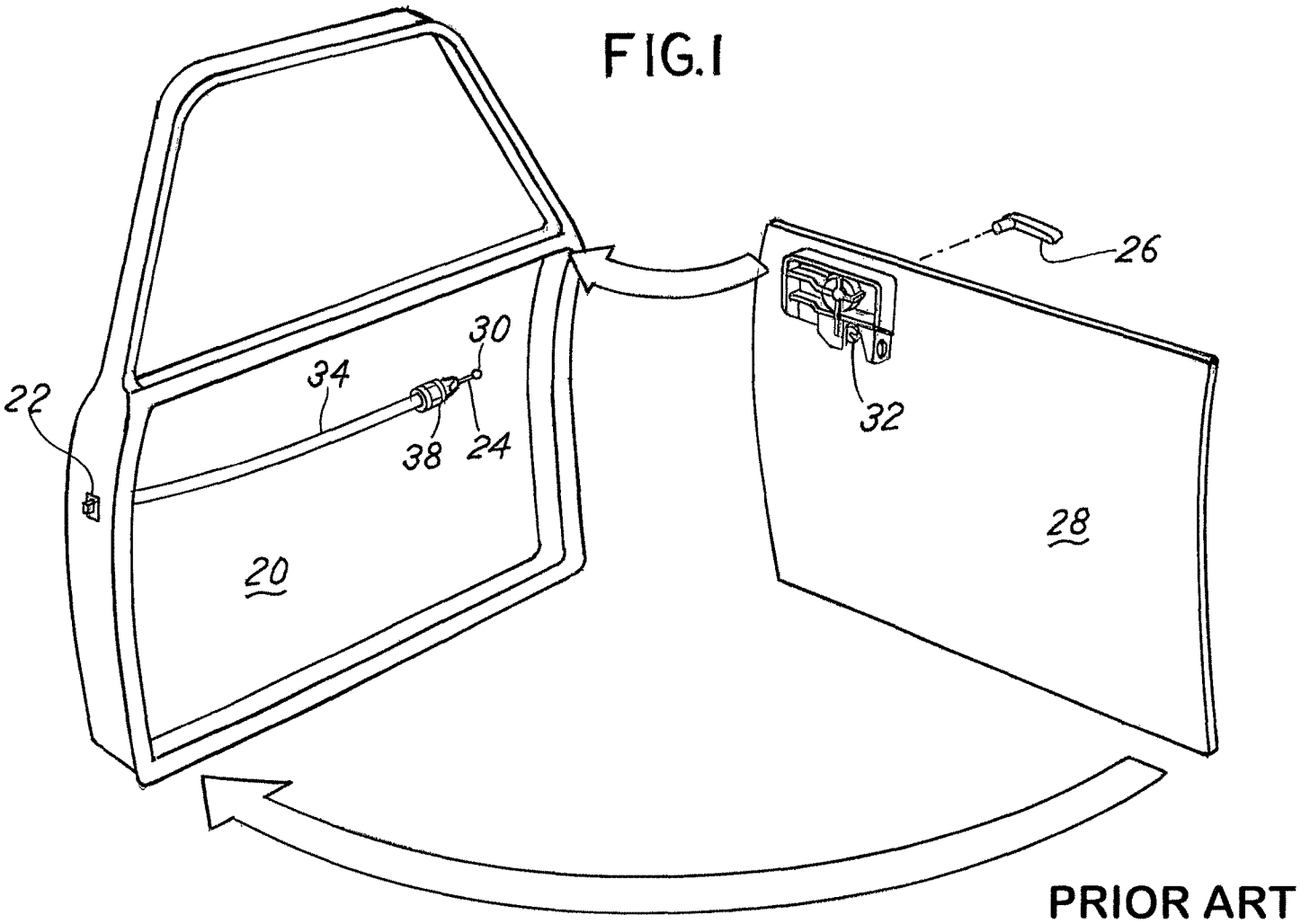
FIG. 1 is a diagrammatic view of an outer door panel and an inner door panel of a vehicle which incorporate a connecting cable between a door latch mounted to or on the outer panel and an inner door handle wherein the connecting cable is housed in a sheath and wherein the sheath includes a cable guide bushing which is connectable through an opening passage to the inner door panel.
Figure 4:
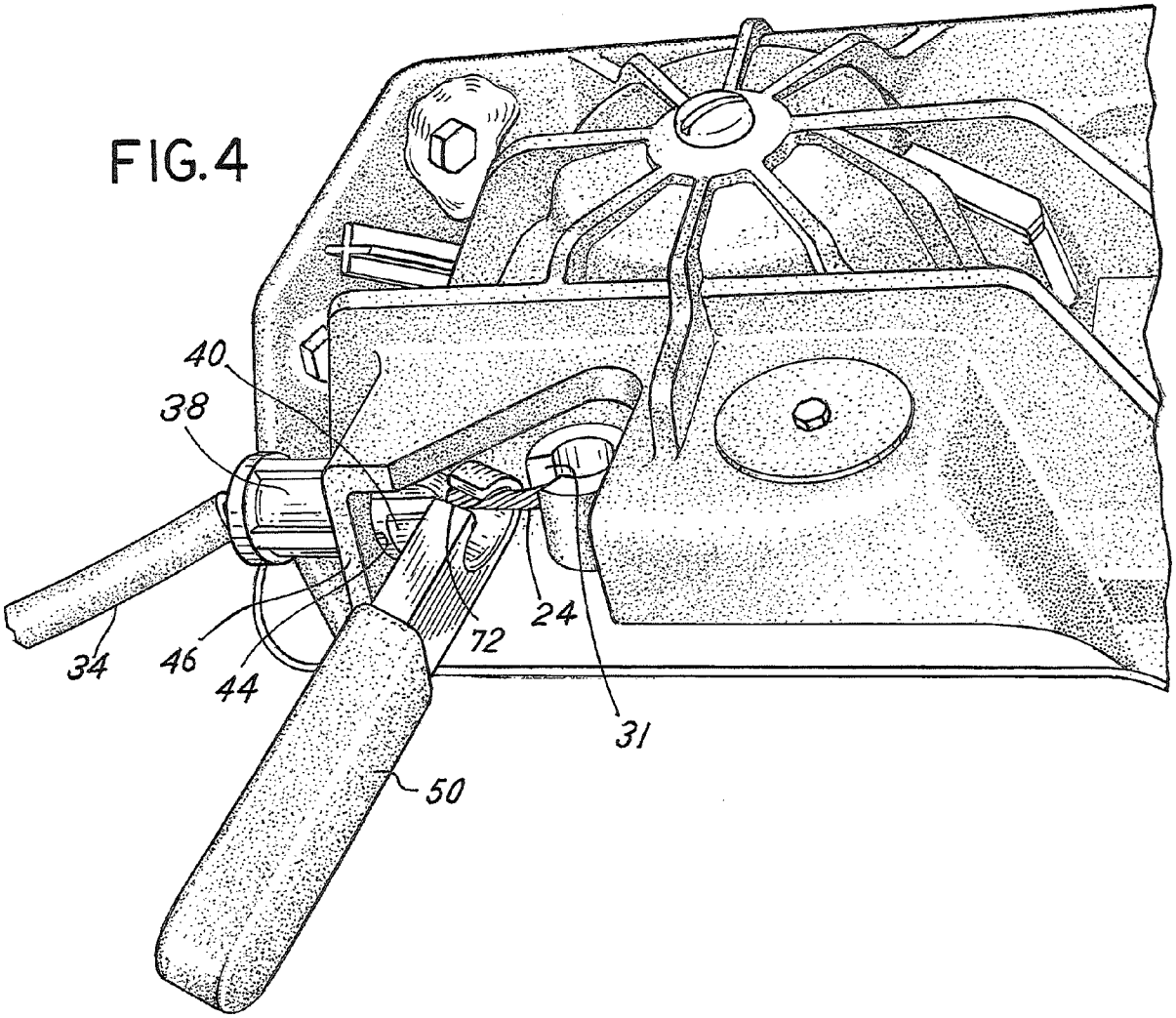
FIG. 4 depicts a portion of an inner door panel wherein the cable guide bushing is inserted and retained in the door panel by engagement of the ears or lugs and further depicts the positioning of an embodiment of the tool of the invention with the cable guide or cable sheath bushing.

Referring to FIG. 1 and FIG. 4, there is depicted the general environment in which the tool of the invention is utilized. An outer door panel 20 includes a latch 22 which is connected for actuation by means of a cable 24 to an inner door handle 26 mounted on an inner door panel 28. The cable 24 typically fits through a slot 31 in handle 26 and includes a ball 30 which fits in a retention recess 32 on the end of a spindle of inner door handle 26 which is pivotally or otherwise mounted on the inner door panel 28 in a manner which allows manual access from the vehicle interior. Further, the cable 24 is slidably mounted in a sheath 34 which is attached to and extends from the cable bushing 38 to the door latch 22 mounted in outer panel 20. The cable sheath 34 protects the cable 24 and facilitates sliding movement of cable 24 upon actuation of the inner door handle 26 to, in turn, effect movement of the latch 22. When the component parts of the door including the outer door panel 20 and inner door panel 28 are assembled, the inner door panel 28 is an integral part of a total door assembly hinged to a vehicle body.

Figure 2:
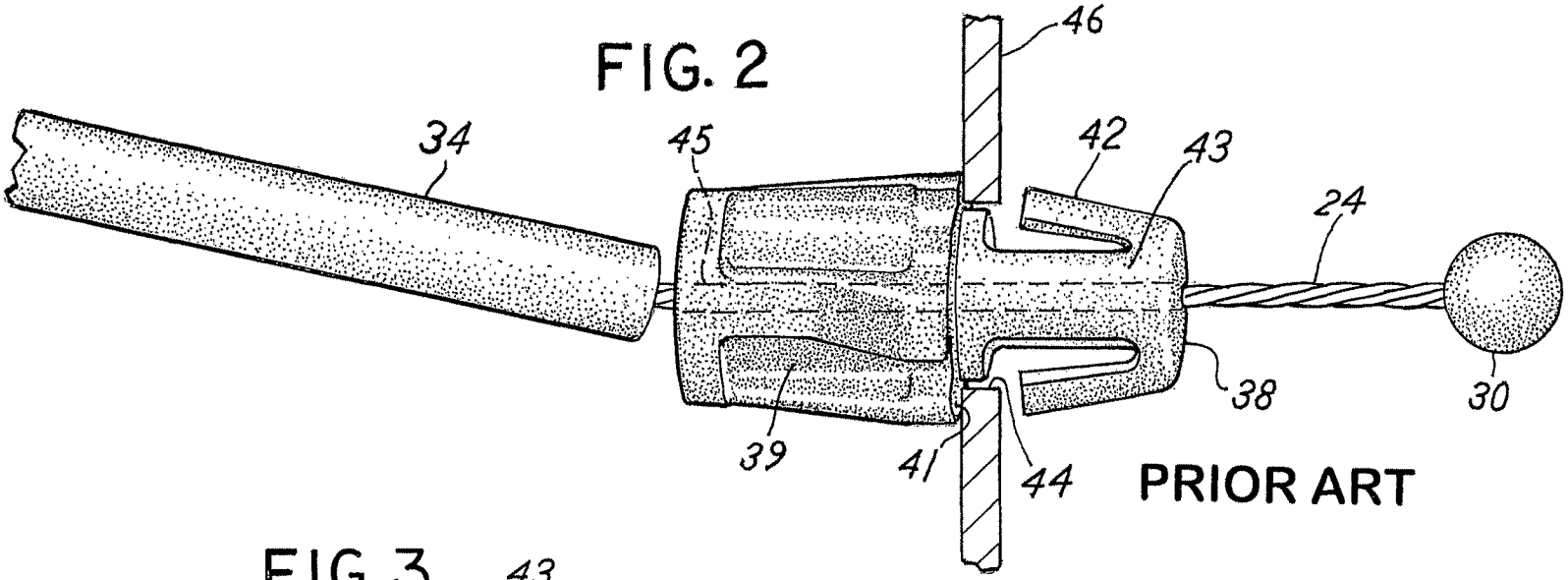
FIG. 2 PRIOR ART
FIG. 2 depicts a cable guide sheath and bushing and a cable fitted within the bushing.
Figure 3:
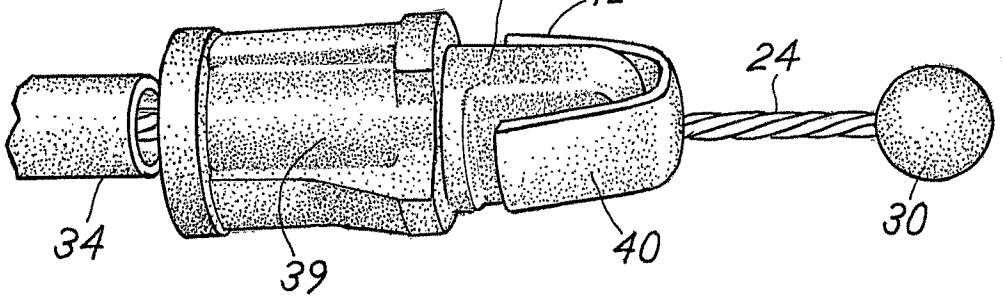
FIG. 3 depicts a cable sheath or guide bushing and the collapsible retention tabs, lugs or ears designed to engage a compatible opening or passage in the inner door panel of the door assembly.

FIGS. 2 and 3 illustrate in greater detail the construction of a cable guide or cable sheath bushing 38. The bushing 38 is a generally annular, molded polymeric or plastic element which typically includes a pair of spaced, opposed, flexible ears 40 and 42 which may be fitted through an opening 44 in a bracket 46 of the inside of inner door panel 28. The cable 24 is slidably movable through the annular bushing 38 and attached sheath 34. The sheath 34 is held in place attached to the inner door panel 28 by the bushing 38. The cable 24 is attached to and locked to the inner door handle 28 of the vehicle by ball 30 as described and as depicted in greater detail in FIG. 4.

As illustrated in FIGS. 2 and 3, the bushing 38 includes an annular through passage 45 for the cable 24. The bushing 38 further includes a main body section 39 defining an annular land or flange 41 from which annular and coaxial rod section 43 extends from and is integral with the body section 39. The rod section 43 includes generally axially extending lateral side ears 40 and 42 which may be elastically deformed to fit generally flush against the rod section 43. The rod section 43 may be positioned or forced through opening 44 in bracket 46 on the inside of the inner panel 28. Upon positioning or insertion of rod 43 and ears 40, 42 through the opening 44 the ears 40, 42 will elastically pivot outwardly from the rod section 43 against bracket 46 thereby locking the bushing 38 in position through the opening 44. The cable 24 with the attached ball 30 is then attached to the inner door handle 26. The cable 24 may freely move or slide in the sheath 34. An object of the invention therefore is to compress the ears 40 and 42 against the rod 43 in order to enable the bushing 38 to be removed from the opening 44. The cable 24 with the attached ball 30 may thus be withdrawn through the opening 44 which has a diameter D.

Figure 5:
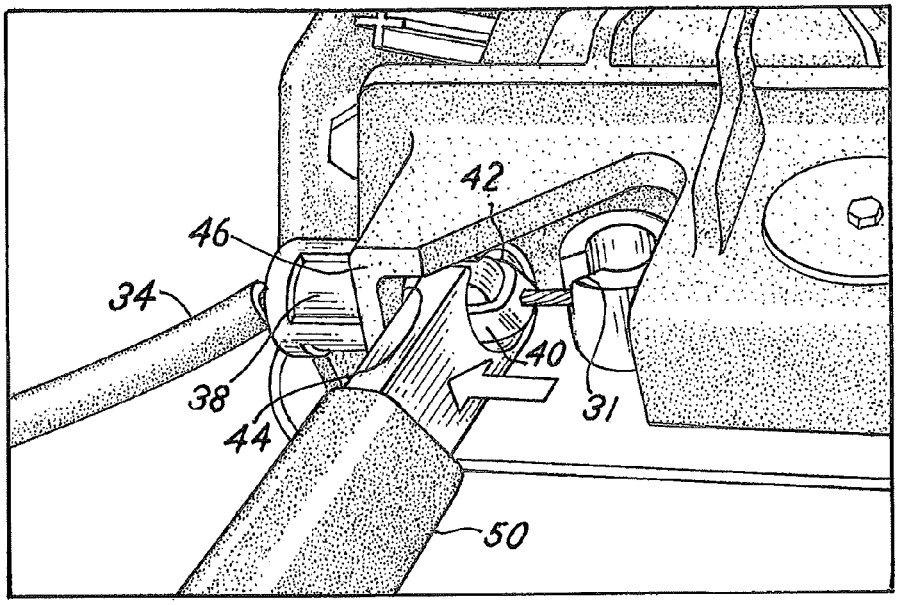
FIG. 5 depicts the positioning of the tool on the cable sheath bushing to release the bushing from engagement with the inner door panel of the vehicle door.
Figure 6:
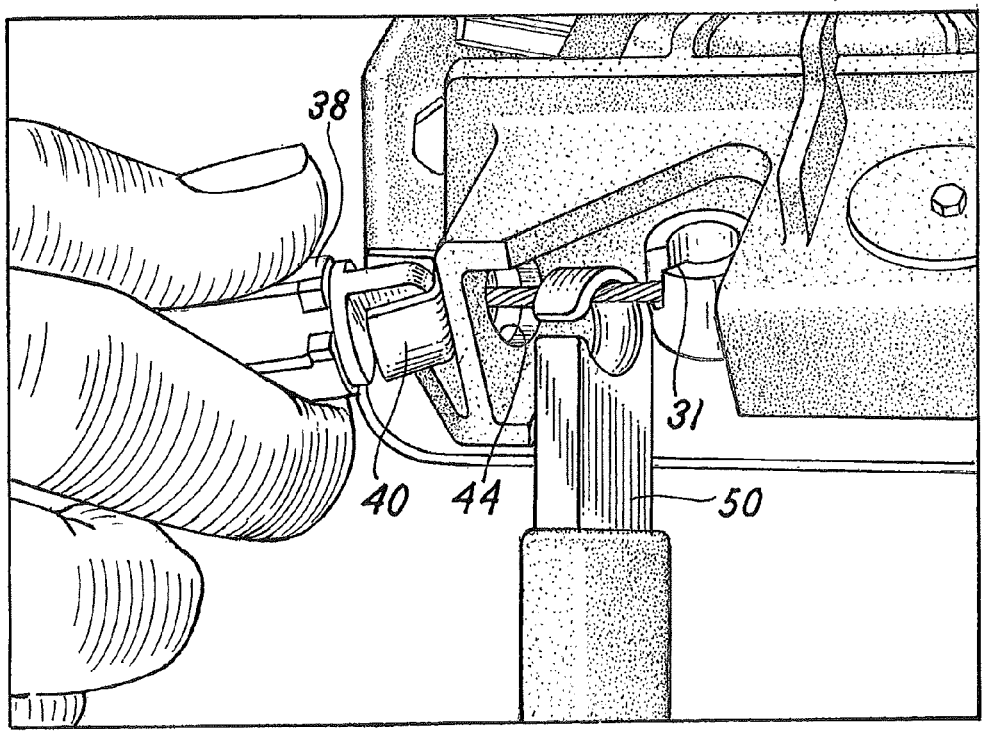
FIG. 6 illustrates removal of the cable guide bushing from the inner door panel as a result of engagement by the tool of the invention.
Figure 7:
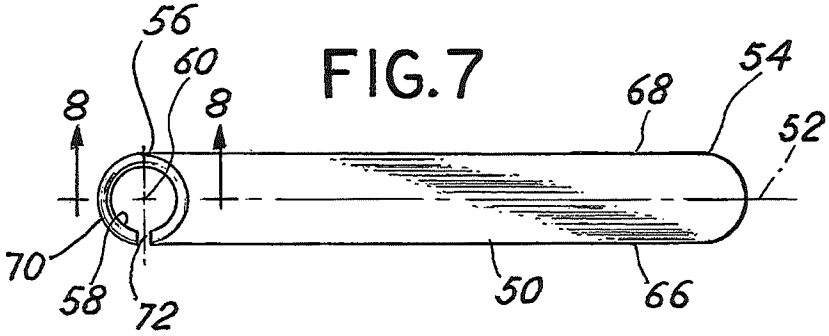
FIG. 7 is a side elevation of the tool of an embodiment of the invention.
Figure 8:
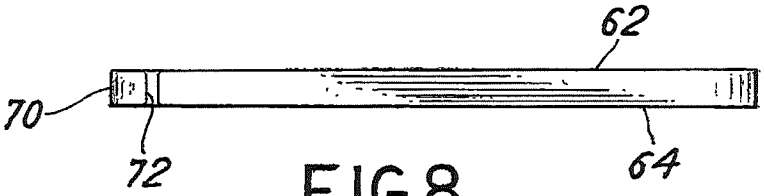
FIG. 8 is a top view of the tool of FIG. 6.
Figure 9:
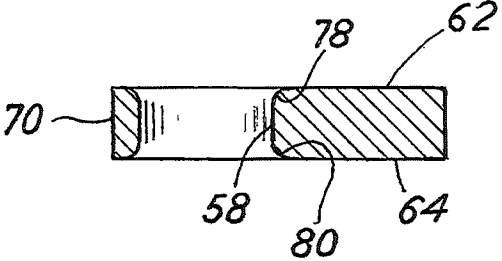
FIG. 9 is a sectional view of the tool of FIG. 7 taken along the line 8-8.

Referring to FIGS. 7, 8 and 9 there is depicted a tool use of which is illustrated in FIGS. 4, 5 and 6. The tool comprises an elongate bar 50 having a generally rectangular parallelepiped configuration and a longitudinal axis 52 centered on the medial dimension and line between the opposite ends; namely, the first end 54 and second end 56 of the tool 50.

The first end 54 typically includes a grip material such as vinyl grip material depicted in FIG. 4. The opposite or second end 56 includes a through-passage 58 having a constant radius about a center axis 60 which is normal or transverse to the longitudinal axis 52 and lies on said axis 52. The bar 50 further includes a first lateral side 66 and a second opposite, parallel, lateral side 68. It further includes a top surface or side 62 and the bottom, parallel surface side 64. Additionally, the second end 56 includes a radiused surface or partially circular surface 70 connecting bottom side 64 and top side 62 centered about the center of through-passage 58. Second lateral top side 66 includes a radial through slot 72 which is in the range of 6 to 14% of the circumference of the through-passage 58 and connects to passage 58 from first lateral side 66. The slot 72 is normal or transverse to the axis 52 as well as the plane of the top side 62 and bottom side 64. The slot 72 has a width dimension that is slightly greater than the diameter of the cable 24. The slot 72 thus has a lateral uniformly spaced sides which provide a separation slightly greater than the diameter of the cable 24.

An aspect of the invention is the design of the through-passage 58. As depicted in FIG. 9, the through-passage 58 includes arcuate or axial radius sections 78, 80 intermediate the top side walls 62 and bottom side wall 64 which are uniform about the circumference of the passage 58 and which are equal on the opposite sides or faces 62 and 64 of the tool. The arcuate sections 78 and 80 each have a radius of about 33% or ⅓ of the dimension between the lateral sides 62 and 64. The radius size of arcuate section 78, 80 of the through-passage 58 enable reversal of the positioning of the tool when it is used for its designed purpose. The diameter size of opening 58 of the tool is generally the dimension D necessary to compress the bushing 38, especially the compressed ears 40 and 42, to fit through passage 58. Thus the diameter of opening 58 of the tool is generally slightly less than the diameter of the opening 44, typically up to about 4% to 5% less as measured at the most narrow portion of the opening 58. Preferably the opening 58 through the tool is cylindrical to facilitate ease of alignment and positioning of the tool to engage the busing 38 with uniform compressive force.

The curved distal side or end surface 54 of the tool has a radius in the range of about 1.2 to 1.5 the radius of the through-passage 58 and an optimal radius of about 1.4 times the radius of the through-passage 58. The thickness of the second end 56 or the distance between the sides 62 and 64 is in the range of ¼ to ⅛ of the circumference of the through-passage 58.

The method of use of the tool is illustrated in FIGS. 4, 5 and 6. Referring to FIG. 4 the tool is first positioned by placing the cable 24 through the slot 72 and fitting the through-passage 58 over the ears 40 and 42 of the guide bushing 38. The tool is then manipulated or pushed onto the opposed ears 40 and 42 to release the guide bushing 38 from the inner door panel 28 as depicted in FIG. 5. The bushing 38 may then be manually removed from the mounting bracket 46 or the inner door panel 28, FIG. 6.

While there has been set forth a preferred embodiment of the invention, various alternations and changes may be made to the tool as described and to the embodiment depicted without altering the spirit and scope of the invention. For example, the material used to make the tool may be varied. Correlation of the dimensions is a feature of the invention but the configuration of the first end or handle end may be varied. Thus changes made to the subject matter of the invention are to be limited only by the following claims and equivalents thereof.

What is claimed is:

1. A method for removal of a cable sheath bushing from engagement with a door handle mounted on an inside door panel having an inside door bracket with a bracket opening, said bushing including a body section with an annular through-passage for a cable, an annular flange spaced from a rod section to form a slot, said rod section including first and second compressible spaced, elastic cantilever ears projecting axially from the rod section, said rod section further including a rod end, said bushing fitted through and retained in the opening of said support bracket compatibility sized to receive the rod section and ears with a cable extending through the annular through-passage, comprising the steps of:

(a) selecting a tool comprising an elongate generally rectangular, parallelepiped bar having a first handle grip end, an opposite second bushing engagement end, a longitudinal dimension and a substantially straight medial axis between the first grip end and the second bushing engagement end, a generally uniform thickness of said second bushing engagement end transverse to the axis, said second bushing engagement end including a uniform, generally circular through-passage with a circumference, said through-passage transverse to the axis and having a generally continuous, smooth transverse and constant radius surface with a center on the axis, said second bushing end having a generally flat top surface and a generally parallel flat bottom surface, said top surface and bottom surface parallel to the axis and connected by a circular, curved distal end surface having a uniform radius with said through-passage center, a radial slot transverse to the axis through the top surface connected to the circular through-passage, said radial slot comprising 6 to 14% of the circumferential dimension of the through-passage, said longitudinal dimension at least two (2) times the circumference of the through-passage, said second grip end thickness in the range of ¼ to ⅜ of the circumference of said through-passage, said through-passage including first and second uniformly equally arcuate, constant radius surfaces forming respectively a radius along a juncture of the smooth transverse surface and joining the top surface and the bottom surface to the through-passage, the circular curved distal end surface having a radius about 1.2 to 1.5 the radius of the through-passage;

(b) manually gripping the grip end of said tool;

(c) manipulating the radial slot of the tool over the cable at the rod end of the bushing to generally align the through-passage transverse to the axis, and position the cable in the through-passage, (d) engaging the through-passage of the tool axially against the cantilever ears and pushing to fit the ears generally flush against the rod section; and (e) manipulating and withdrawing the bushing from the opening by axially pulling the body section to thereby detach and remove the bushing and a cable from the bracket opening.

2. The method of claim 1 wherein the radius of the circular curved distal end surface is about 1.4 times the radius of the through-passage.

3. The method of claim 1 wherein the door panel bracket opening has a minimum diameter dimension and said tool through-passage has a lesser maximum diameter of about 95% of the door panel minimum diameter.

* * * * *